US007242242B2

(12) United States Patent
Bedarida et al.

(10) Patent No.: US 7,242,242 B2
(45) Date of Patent: Jul. 10, 2007

(54) FAST DYNAMIC LOW-VOLTAGE CURRENT MIRROR WITH COMPENSATED ERROR

(75) Inventors: Lorenzo Bedarida, Vinercate (IT); Danut Manea, Cupertino, CA (US); Mirella Marsella, Milan (IT); Andrea Sacco, Alessandria (IT)

(73) Assignee: Atmel Corporation, San Jose, CA (US)

( * ) Notice: Subject to any disclaimer, the term of this patent is extended or adjusted under 35 U.S.C. 154(b) by 0 days.

(21) Appl. No.: 11/393,153

(22) Filed: Mar. 29, 2006

(65) Prior Publication Data

US 2006/0170490 A1 Aug. 3, 2006

Related U.S. Application Data

(62) Division of application No. 11/102,031, filed on Apr. 7, 2005, now Pat. No. 7,084,699, which is a division of application No. 10/407,731, filed on Apr. 3, 2003, now abandoned.

(30) Foreign Application Priority Data

Sep. 19, 2002 (IT) ..... 2002A0816

(51) Int. Cl.
*G05F 1/10* (2006.01)

(52) U.S. Cl. ..... 327/543

(58) Field of Classification Search ..... 323/315, 323/316; 327/535, 538, 540, 541, 543
See application file for complete search history.

(56) References Cited

U.S. PATENT DOCUMENTS

| | | | | |
|---|---|---|---|---|
| 5,672,993 | A | 9/1997 | Runaldue | |
| 5,939,933 | A * | 8/1999 | Wang | 327/512 |
| 5,966,005 | A | 10/1999 | Fujimori | |
| 6,211,659 | B1 | 4/2001 | Singh | |
| 6,351,181 | B1 * | 2/2002 | Vittoz | 327/541 |
| 6,788,134 | B2 | 9/2004 | Secareanu | |

* cited by examiner

*Primary Examiner*—Jeffrey Zweizig
(74) *Attorney, Agent, or Firm*—Sierra Patent Group, Ltd.

(57) ABSTRACT

A current mirror comprising: current source; a first p-channel transistor having a source coupled to operating potential, and a gate and drain coupled to current source; a second p-channel transistor having a source coupled to operating potential, a gate coupled to gate of first p-channel transistor, and a drain; a zero-threshold p-channel transistor having a source coupled to drain of second p-channel transistor, a gate coupled to gate of first p-channel transistor, and a drain; a first n-channel transistor having a source coupled to ground, and a gate and drain coupled to drain of zero-threshold p-channel transistor; a second n-channel transistor having a source coupled to ground, a gate coupled to gate of first n-channel transistor, and a drain; and a zero-threshold n-channel transistor having a source coupled to drain of second n-channel transistor, a gate coupled to gate of first n-channel transistor, and a drain coupled to current-output node.

11 Claims, 6 Drawing Sheets

FAST DYNAMIC LOW-VOLTAGE CURRENT MIRROR WITH COMPENSATED ERROR

CROSS-REFERENCE TO RELATED APPLICATIONS

This application is a divisional of U.S. application Ser. No. 11/102,031, filed Apr. 7, 2005, now U.S. Pat. No. 7,084,699 which is a divisional of U.S. application Ser. No. 10/407,731, filed Apr. 3, 2003, now abandoned, which claims priority to Italian Application Serial Number 2002A000816, filed Sep. 19, 2002, all of which are hereby incorporated by reference as if set forth herein.

BACKGROUND OF THE INVENTION

1. Field of the Invention

The present invention relates to current mirror circuits. More particularly, the present invention relates to a low-voltage current mirror having reduced mirroring error.

2. The State of the Art

The basic prior-art current mirror, shown in FIG. 1, is well known. Current source 10 is coupled to the drain and gate of n-channel MOS transistor 12 and to the gate of n-channel MOS transistor 14.

The basic principle of operation of the current mirror of FIG. 1 is that if the VGS voltages of two identical MOS transistors 12 and 14 operating in the saturation region are equal, then their channel currents should be equal and in first approximation expressed as follows:

$$I_i=I_0=(\beta/2)(W/L)(V_{GS}-V_{th})^2$$

There are three effects that cause the current mirror to operate differently from the ideal case: channel length modulation; threshold offset between two different transistors; and imperfect geometrical matching. The second and third effects result from process and layout imperfections.

The first effect, known as the Early effect, depends on the shortening of the effective channel length in the saturation region caused by $V_{ds}$ being greater than $V_{dsat}$ limit ($V_{dsat}=V_{gs}-V_{th}$). Under these conditions, the depletion region around the drain junction becomes increasingly wider, causing the standard drift transport equations to be substituted by more complex equations which take into account the diffusion effect of charge through the depleted region due to the negative concentration gradient.

This effect becomes more evident as the channel length L decreases. The Early effect coefficient $\lambda$ is inversely proportional to L($\lambda \propto 1/L$). The following expression of an NMOS drain current in the saturated region translates the preceding considerations, giving an idea of how the real mirrored current will differ from the reference current.

$$I_i=I_0=(\beta/2)(W/L)(V_{GS}-V_{th})^2(1+\lambda V_{ds})$$

Considering the small-signal equivalent circuit, it is possible to derive the output resistance, which is a good measure of the perfection of a current mirror as a current source. Higher performance current mirrors will attempt to increase the value of $r_{out}$ with respect to the standard case.

The standard current mirror of FIG. 1 has no limitation on $V_{in\ min}$ and $V_{out\ min}$, that is $V_{imin}\approx V_{th1}$; $V_{omin}\approx V_{dsat2}$ The current mirror of FIG. 1 suffers from the Early effect if $V_{ds}\neq V_{gs}$. It has a low output impedance $r_o=1/g_o$:$r_o=1/\lambda I_o$ in the saturation region.

Referring now to FIG. 2, a prior-art Wilson current mirror is shown. This current mirror introduces a negative feedback loop with the addition of n-channel MOS transistor 16. If $I_o$ increases, the current $I_i$ mirrored by n-channel MOS transistor 14 tries to increase in contrast to the hypothesis that $I_i$ is constant. $V_i$ decreases in order to counter this effect, thus reducing the current flowing through n-channel MOS transistor 14. This effect can also be explained in terms of output impedance increase induced by negative current feedback. As the n-channel MOS cascode transistor 14 enters the linear region, the output impedance of this current mirror decreases, countering the advantageous effects of the feedback structure.

In order to make the Wilson current mirror more symmetrical, a NMOS diode formed from n-channel MOS transistor 18 may be added to its first branch as shown in FIG. 3, thus equalizing the $V_{ds}$ voltage drop across n-channel MOS transistor 12 and n-channel MOS transistor 14. This results in an output impedance equal to that of the current mirror of FIG. 2, but the mirroring factor ($\epsilon=I_o/I_i$) has been improved.

Referring now to FIG. 4, a prior-art cascode current mirror is shown. This cascode current mirror is similar to the Wilson mirror, but the gates of n-channel MOS transistor 12 and n-channel MOS transistor 14 are coupled to the drain of n-channel MOS transistor 12 instead of to the drain of n-channel MOS transistor 14.

Like the Wilson current mirror, the cascode current mirror of FIG. 4 has a high output impedance and mirroring precision, since these improvements are dependant on the saturation of the n-channel MOS transistor 18. However, like the Wilson current mirror, the cascode current mirror is penalized by the minimum $V_i$ and/or $V_o$ operating value, which is about $2V_{th}$.

Referring now to FIG. 5, a prior-art high-swing cascode current mirror is shown. This circuit introduces a n-channel MOS source-follower transistor 20 between the gates of n-channel MOS transistor 18 and n-channel MOS transistor 16 and n-channel MOS bias transistor 22 in series with n-channel MOS source-follower transistor 20. N-channel MOS source-follower transistor 20 acts as a level shifter, thus biasing n-channel MOS transistor 14 at the high limit of its saturation region. Like the cascode current mirror of FIG. 4, the high-swing cascode current mirror of FIG. 5 has a high output impedance but has the advantage of reducing the minimum $V_o$ operating value. The $V_i$ is subject to the same limitation as the cascode current mirror of FIG. 4.

All of the current mirrors of FIGS. 1 through 5 are limited in their minimum power supply voltage value $V_{DD}$. This limiting factor makes these circuits unsuitable for low-voltage applications.

Referring now to FIG. 6, a current mirror is shown in which a biasing circuit including n-channel MOS transistor 24 driven from current source 26 has been added to drive the gates of n-channel MOS transistors 16 and 18. N-channel MOS transistor 12 is not in diode configuration, having its gate coupled to the drain of n-channel MOS transistor 18.

If the transistors in the circuit are properly sized ($(W/L)_{18}=(W/L)_{16}=(m/n)^2(W/L)$ and $(W/L)_0=(1/(1+n/m)^2(W/L))$ it is possible to reduce the minimum $V_i$ and $V_0$ operating value to about only one $V_{th}$ (if m>>n) without affecting the large output impedance and to improve the current matching capability (being $V_{ds1}=V_{ds2}+(V_{dsat})_{W/L}$), thus improving the mirroring factor $\epsilon=I_0/I_i$.

BRIEF DESCRIPTION OF THE INVENTION

The present invention provides current mirrors suitable for low-voltage power supply applications.

According to one illustrative embodiment of the present invention, a current mirror comprises a current source; a first n-channel MOS transistor having a drain and a gate coupled to the current source and a source coupled to a source potential; a second n-channel MOS transistor having a drain, a gate coupled, to the drain and gate of the first n-channel MOS transistor, and a source coupled to the source potential; and a zero-threshold-voltage MOS transistor having a source coupled to the drain of the second n-channel MOS transistor, a gate coupled to the drain and the gate of the first n-channel MOS transistor, and a drain comprising an output-current node.

According to another illustrative embodiment of the present invention, a current mirror comprises a first current source; a first n-channel MOS transistor having a drain and a gate coupled to the current source and a source coupled to a source potential; a second n-channel MOS transistor having a drain, a gate coupled to the drain and the gate of the first n-channel MOS transistor, and a source coupled to the source potential; a third n-channel MOS transistor having a source coupled to the drain of the second n-channel MOS transistor, a gate, and a drain comprising an output-current node; a second current source; a p-channel MOS transistor having a drain coupled to the source potential, a source coupled to the second current source and the gate of the third n-channel MOS transistor, and a gate coupled to the drain and the gate of the first n-channel MOS transistor.

According to another illustrative embodiment of the present invention, a current mirror comprises a current source; a first p-channel MOS transistor having a source coupled to an operating potential, and a gate and a drain coupled to the current source; a second p-channel MOS transistor having a source coupled to the operating potential, a gate coupled to the gate of the first p-channel MOS transistor, and a drain; a first n-channel MOS transistor having a source coupled to ground, and a gate and a drain coupled to the drain of the second p-channel MOS transistor; a zero-threshold n-channel MOS transistor having a drain coupled to a current-output node, a gate coupled to the gate of the first n-channel MOS transistor, and a source; and a second n-channel MOS transistor having a source coupled to ground, and a gate coupled to the gate of the first n-channel MOS transistor and a drain coupled to the source of the zero-threshold n-channel MOS transistor.

According to another illustrative embodiment of the present invention, a current mirror comprises a current source; a first n-channel MOS transistor having a drain coupled to ground, and a gate and a source coupled to the current source; a second n-channel MOS transistor having a source coupled to ground, a gate coupled to the gate of the first n-channel MOS transistor, and a drain; a first p-channel MOS transistor having a source coupled to an operating potential, and a drain and gate coupled to the drain of the second n-channel MOS transistor; a zero-threshold p-channel MOS transistor having a drain coupled to a current-output node, a gate coupled to the gate of the first p-channel MOS transistor, and a source; a second p-channel MOS transistor having a source coupled to the operating potential, a gate coupled to the gate of the first p-channel MOS transistor and a drain coupled to the source of the zero-threshold p-channel MOS transistor.

According to another illustrative embodiment of the present invention, a current mirror comprises a first current source; a first p-channel MOS transistor having a source coupled to an operating potential, and a gate and a drain coupled to the first current source; a second p-channel MOS transistor having a source coupled to the operating potential, a gate coupled to the gate of the first p-channel MOS transistor, and a drain; a third p-channel MOS transistor having a drain coupled to a current-output node, a source coupled to the drain of the second p-channel MOS transistor, and a gate; a second current source; an n-channel MOS transistor having a source coupled to the operating potential, a gate coupled to the gate of the first p-channel MOS transistor, and a drain coupled to the second current source and the gate of the third p-channel MOS transistor.

According to another illustrative embodiment of the present invention, a current mirror comprises a current source, a first p-channel MOS transistor having a source coupled to an operating potential, and a gate and a drain coupled to the current source; a second p-channel MOS transistor having a source coupled to the operating potential, a gate coupled to the gate of the first p-channel MOS transistor, and a drain; a zero-threshold p-channel MOS transistor having a source coupled to the drain of the second p-channel MOS transistor, a gate coupled to the gate of the first p-channel MOS transistor, and a drain; a first n-channel MOS transistor having a source coupled to ground, and a gate and drain coupled to the drain of the zero-threshold p-channel MOS transistor; a second n-channel MOS transistor having a source coupled to ground, a gate coupled to the gate of the first n-channel MOS transistor, and a drain; and a zero-threshold n-channel MOS transistor having a source coupled to the drain of the second n-channel MOS transistor, a gate coupled to the gate of the first n-channel MOS transistor, and a drain coupled to a current-output node.

BRIEF DESCRIPTION OF THE DRAWING FIGURES

DETAILED DESCRIPTION OF THE INVENTION

Persons of ordinary skill in the art will realize that the following description of the present invention is only illustrative and not in any way limiting. Other embodiments of this invention will be readily apparent to those skilled in the art having benefit of this disclosure.

According to the present invention, it is possible to reduce the Early effect by properly cascoding the mirrored side of a current mirror. Two illustrative methods are shown in FIGS. 7 and 8.

Figure 7:
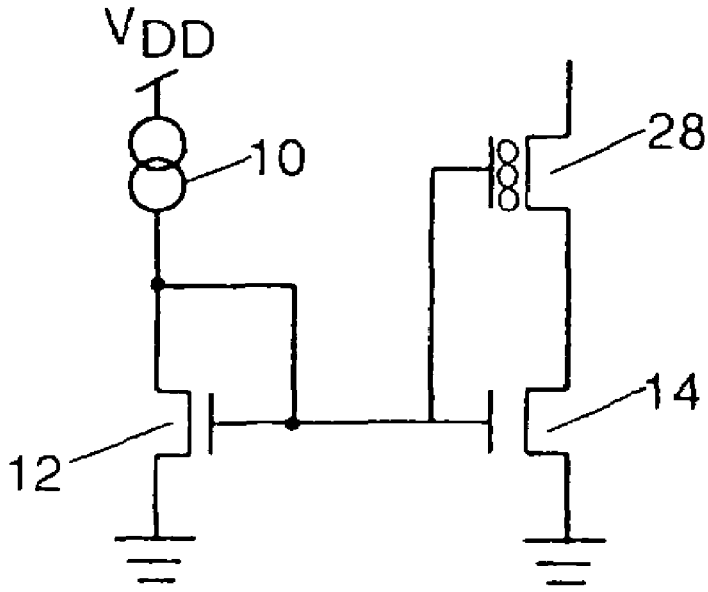
FIG. 7 is a schematic diagram of a first error-compensated current mirror suitable for low-voltage operation according to the present invention.
Figure 8:
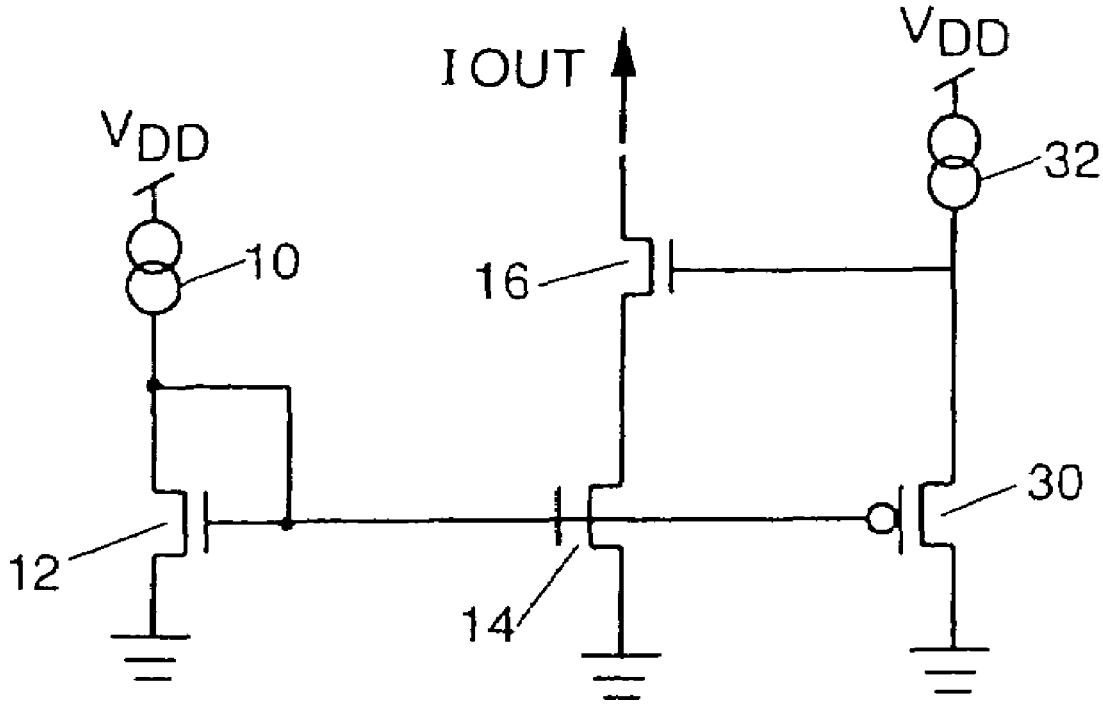
FIG. 8 is a schematic diagram of a second error-compensated current mirror suitable for low-voltage operation according to the present invention.

Referring first to FIG. 7, a zero-threshold cascode current mirror is shown. Current source 10 is coupled to the drain and gate of n-channel MOS transistor 12 and to the gate of n-channel MOS transistor 14. Zero-threshold-voltage MOS transistor 28 is coupled in series with n-channel MOS transistor 14 and its gate is coupled to the gates of n-channel MOS transistors 12 and 14.

In the current mirror of FIG. 7 both n-channel MOS transistors 14 and 28 have their gates coupled to the reference voltage generated by the diode-connected n-channel MOS transistor 12. The resulting scheme is very simple, requiring only a single extra transistor. This current mirror does not suffer from the $V_{DDmin}=2V_{th}$ limitation since the threshold voltage of MOS transistor 28 is close to (ideally) zero. The ideal minimum value of the $V_{in}$ and $V_{out}$ voltages:

$$V_{imin}=V_{th12};\ V_{omin}=V_{dsat14}$$

Figure 1:
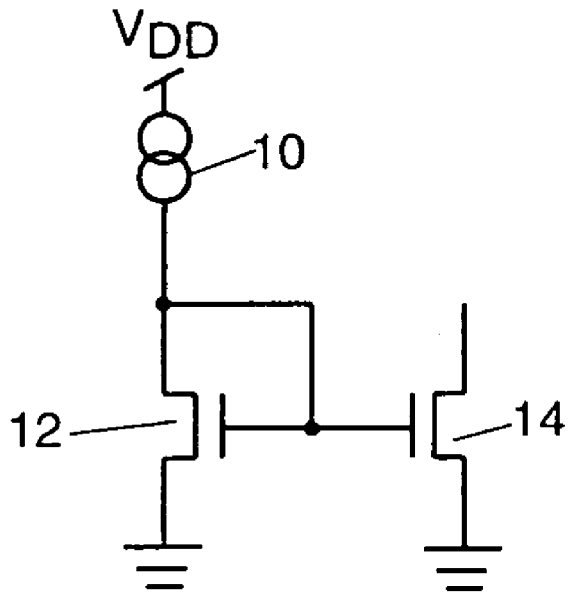
FIG. 1 PRIOR ART
FIG. 1 is a schematic diagram of a classic prior-art current mirror.
Figure 2:
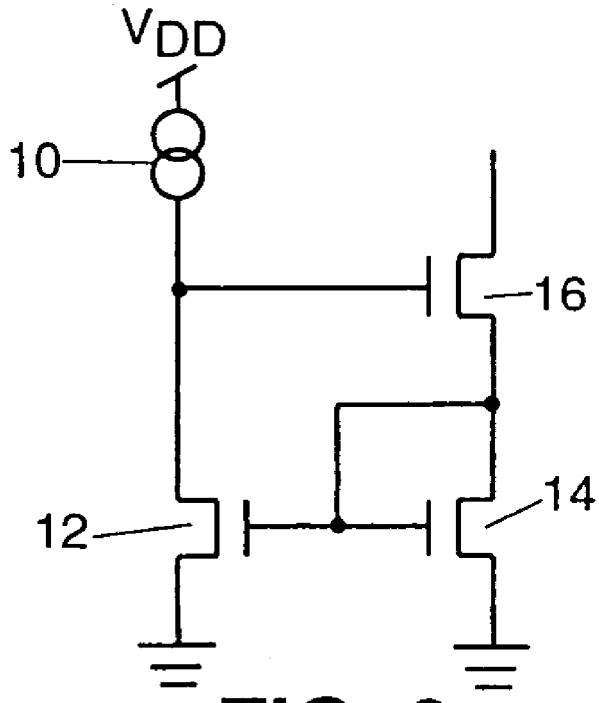
FIG. 2 PRIOR ART
FIG. 2 is a schematic diagram of a prior-art Wilson current mirror.
Figure 3:
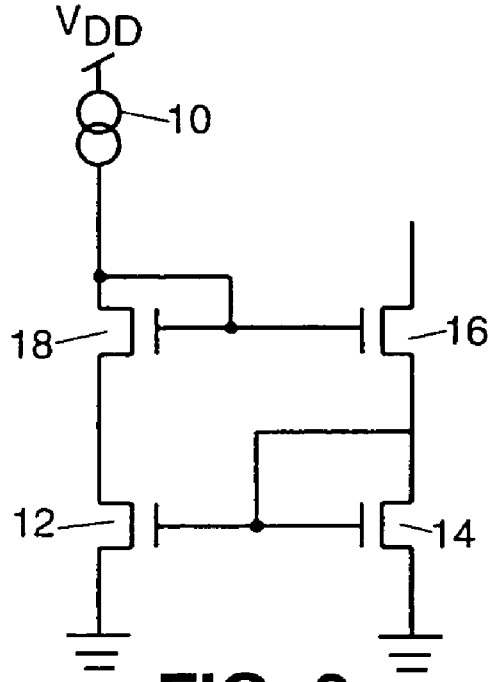
FIG. 3 PRIOR ART
FIG. 3 is a schematic diagram of another variation of a prior-art Wilson current mirror.
Figure 4:
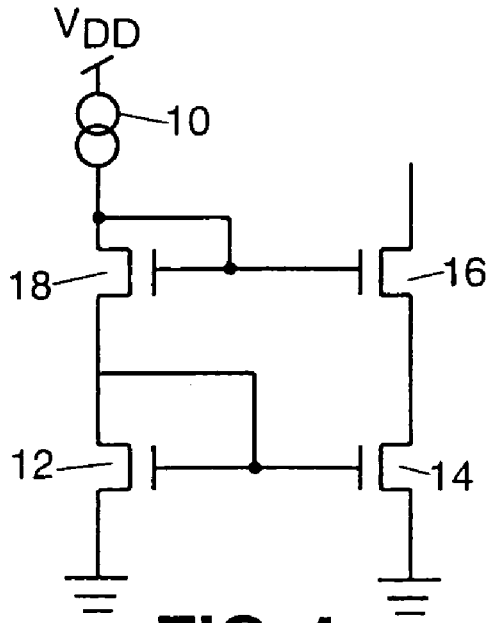
FIG. 4 PRIOR ART
FIG. 4 is a schematic diagram of a prior-art cascode current mirror.
Figure 5:
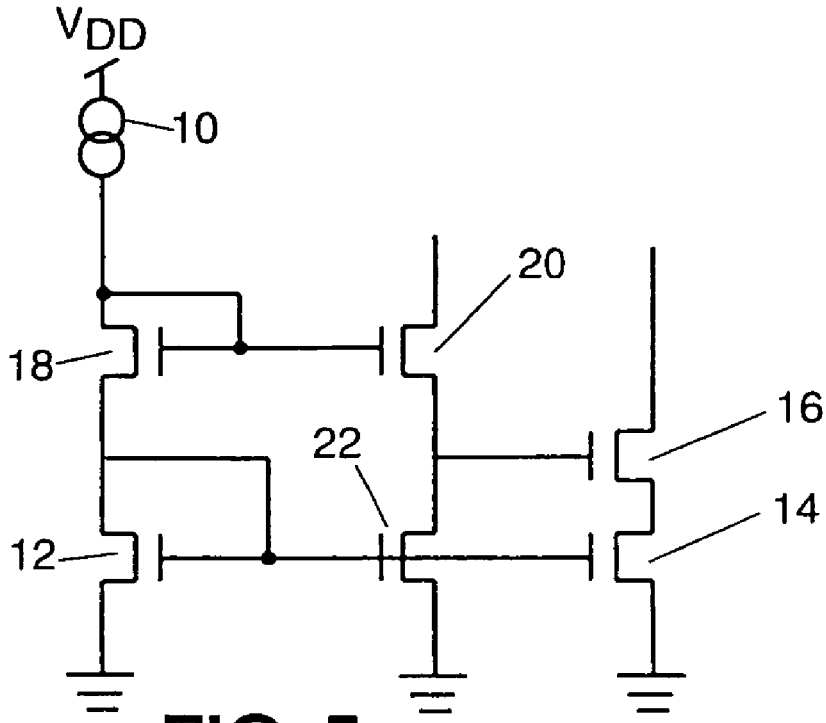
FIG. 5 PRIOR ART
FIG. 5 is a schematic diagram of a prior-art high-swing cascode current mirror.
Figure 6:
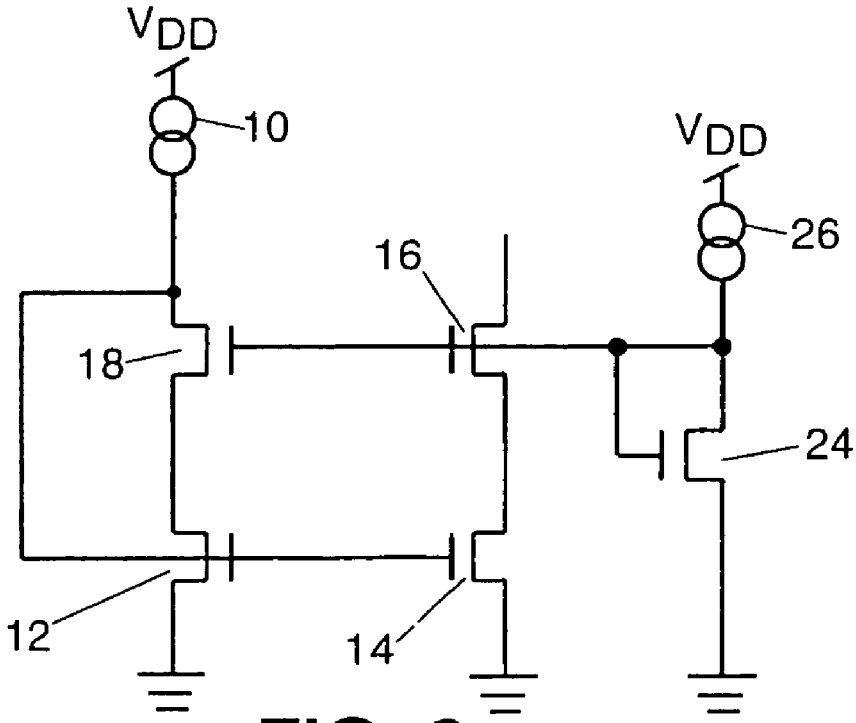
FIG. 6 PRIOR ART
FIG. 6 is a schematic diagram of another prior-art high-swing cascode current mirror.

Considering the mirroring factor $\epsilon=I_o/I_i=(1+\lambda V_{gs12})/(1+\lambda V_{ds14})$, the error is very close to zero ($V_{ds14}=V_{gs12}-V_{th28}\approx V_{gs12}$). Persons of ordinary skill in the art will appreciate that even if the threshold voltage of MOS transistor 28 is not exactly zero but slightly positive, depending on the process technology employed, this mirror circuit plays a significant role in compensating the error of a mirror structure comprising a standard p=mirror followed by an n-mirror (FIG. 3A).

The current mirror of FIG. 7 may be employed in all technologies which include a very-low-threshold-voltage transistor. This may be accomplished either with or without triple well structures to reduce the impact of body effect on the threshold voltage.

Referring now to FIG. 8, a schematic diagram of another illustrative embodiment of the invention shows another possible scheme that reduces the Early effect of the MOS transistor 14 by employing a compensated-threshold cascode standard low-voltage MOS transistor.

In the embodiment of FIG. 8, current source 10 is coupled to the drain and gate of n-channel MOS transistor 12 and to the gate of n-channel MOS transistor 14. A p-channel MOS transistor 30 has its source coupled to a second current source 32, its drain coupled to the source potential at ground, and a gate coupled to the gates of n-channel MOS transistors 12 and 14. N-channel MOS transistor 16 has its gate is coupled to the source of p-channel MOS transistor 30.

In order to compensate for the $V_{ds}$ voltage drop of n-channel MOS transistor 14 caused by the non-zero threshold voltage of n-channel MOS transistor 16, the gate of n-channel MOS transistor 16 is biased by a low-voltage p-channel MOS transistor 30 having its gate line connected to the same gate voltage as n-channel MOS transistors 12 and 14 (the reference voltage generated by n-channel MOS transistor 12). The source of p-channel MOS transistor 30 is coupled to the gate of n-channel MOS transistor 16 so as to bias it to one PMOS threshold plus one NMOS threshold. The p-channel MOS transistor 30 and the cascode n-channel MOS transistor 16 act as opposite level shifters (which compensate each other if there is matching between the n-channel and the p-channel transistors) so that the resulting $V_{ds}$ voltage is the same as the $V_{gs}$ voltage:

$$V_{th32}\approx V_{th16}=>V_{th14}+V_{th32}-V_{th16}\approx V_{th14}=V_{gs14}=V_{ds14}$$

Persons of ordinary skill in the art will observe that because of the configuration of the p-channel MOS transistor, the feedback it induces allows the cascode n-channel transistor to be correctly biased at all possible values of $I_{ref}$ current, which is the same current flow across p-channel MOS transistor 30.

All of the preceding current mirrors have been n-channel current mirrors. The same approach, however, may be used to reduce the Early effect of a p-channel current mirror or to compensate for the error of a current mirror circuit formed by cascading a p-channel transistor with an n-channel transistor.

Figure 9A:
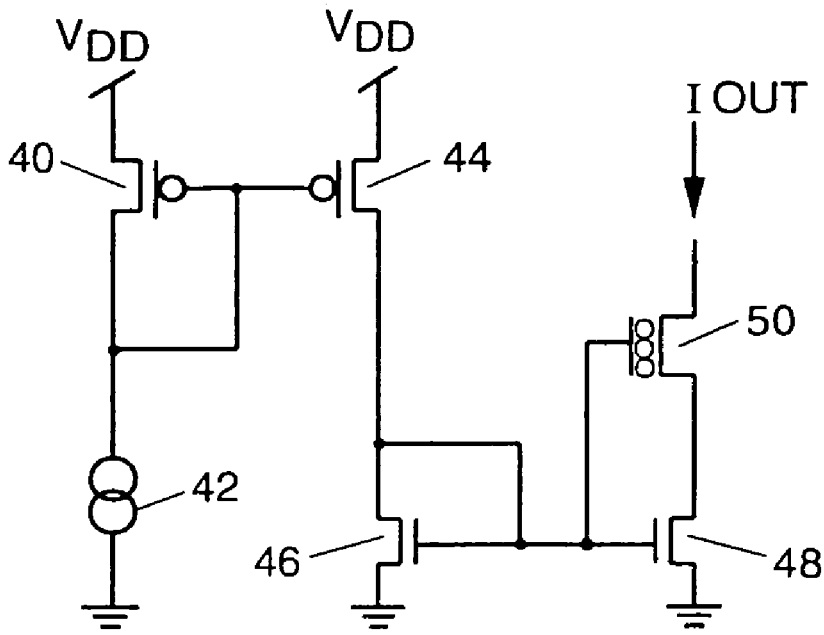
FIGS. 9A through 9D are schematic diagrams of other alternate error-compensated current mirrors employing p-channel MOS transistors and suitable for low-voltage operation according to the present invention.

FIGS. 9A through 9D are examples of p-channel current mirrors according to the present invention. Referring first to FIG. 9A, a schematic diagram of a zero-threshold cascode n-channel current mirror is shown. P-channel MOS transistor 40 is coupled between $V_{DD}$ and a current source 42 referenced to ground. Its gate and drain are coupled to the gate of p-channel MOS transistor 44, whose source is also coupled to $V_{DD}$. The drain of p-channel MOS transistor 44 is coupled to the drain and gate of n-channel MOS transistor 46. The output structure of this current mirror includes n-channel MOS transistor 48 coupled in series with zero-threshold n-channel MOS transistor 50 between ground and the current output node. The gates of MOS transistors 48 and 50 are coupled to the gate and drain of n-channel MOS transistor 46.

Figure 9B:
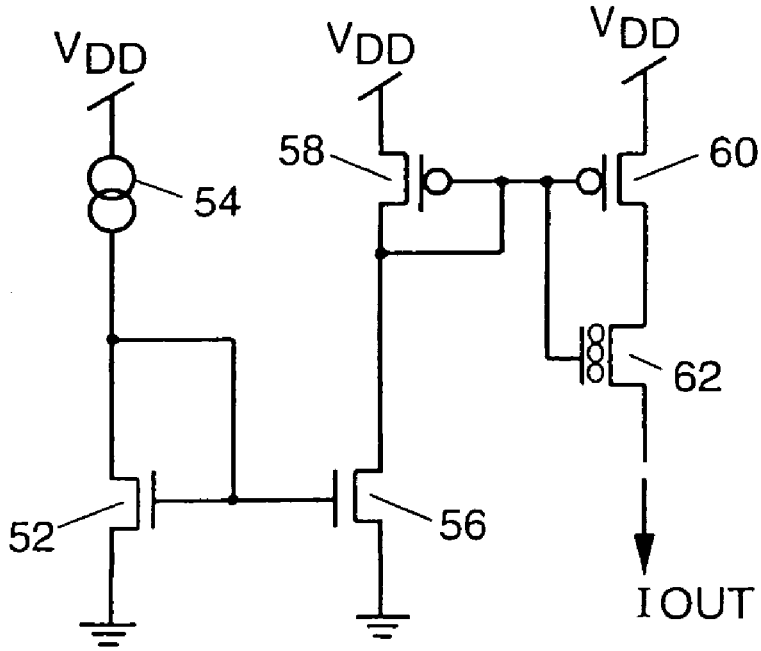

The current mirror circuit illustrated in FIG. 9B is a zero-threshold p-channel cascode p-channel current mirror. N-channel MOS transistor 52 is coupled between ground and a current source 54 referenced to $V_{DD}$. Its gate and drain are coupled to the gate of n-channel MOS transistor 56, whose source is also coupled to ground. The drain of n-channel MOS transistor 56 is coupled to the drain and gate of p-channel MOS transistor 58, whose source is coupled to $V_{DD}$. The output structure of this current mirror includes p-channel MOS transistor 60 coupled in series with zero-threshold p-channel MOS transistor 62 between $V_{DD}$ and the current output node. The gates of MOS transistors 60 and 62 are coupled to the gate and drain of p-channel MOS transistor 58.

The zero-threshold transistors 50 and 62 in FIGS. 9A and 9B perform the same function in their respective circuits. They both serve to reduce the Early effect in the output structures of the current mirrors containing them.

Figure 9C:
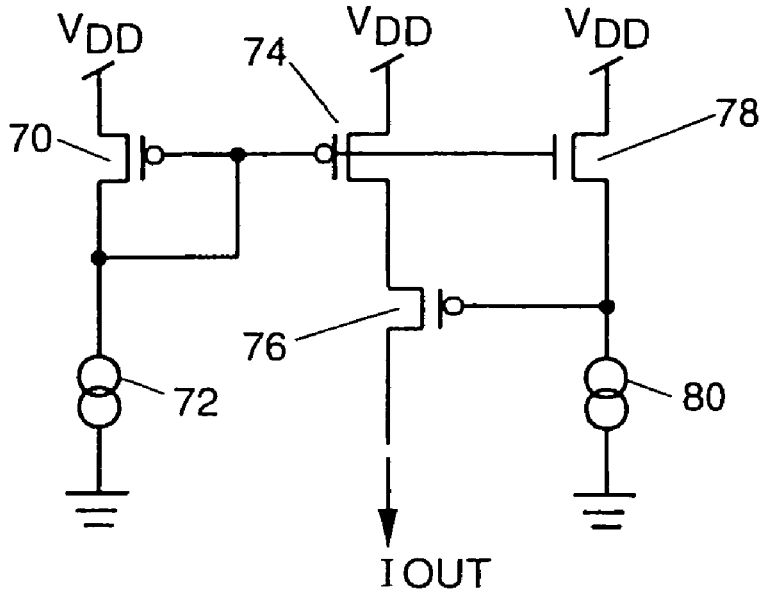

Referring now to FIG. 9C, a compensated-threshold cascode p-channel MOS current mirror is shown. P-channel MOS transistor 70 is coupled between $V_{DD}$ and a current source 72 referenced to ground. Its gate and drain are coupled to the gate of p-channel MOS transistor 74, whose source is also coupled to $V_{DD}$. The drain of p-channel MOS transistor 74 is coupled to the drain of p-channel MOS transistor 76, whose source is the current-output node of the circuit. N-channel MOS transistor 78 is coupled in series with current source 80 between $V_{DD}$ and ground. The gate of n-channel MOS transistor 78 is coupled to the gates of p-channel MOS transistors 70 and 74. The gate of p-channel MOS transistor 76 is coupled to the drain of p-channel MOS transistor 78.

Persons of ordinary skill in the art will observe that the circuit of FIG. 9C is the complement of the circuit of FIG. 8, the p-channel and n-channel devices being reversed. Thus, such skilled persons will understand the operation of the circuit of FIG. 9C from the description of the operation of the circuit of FIG. 8.

Figure 9D:
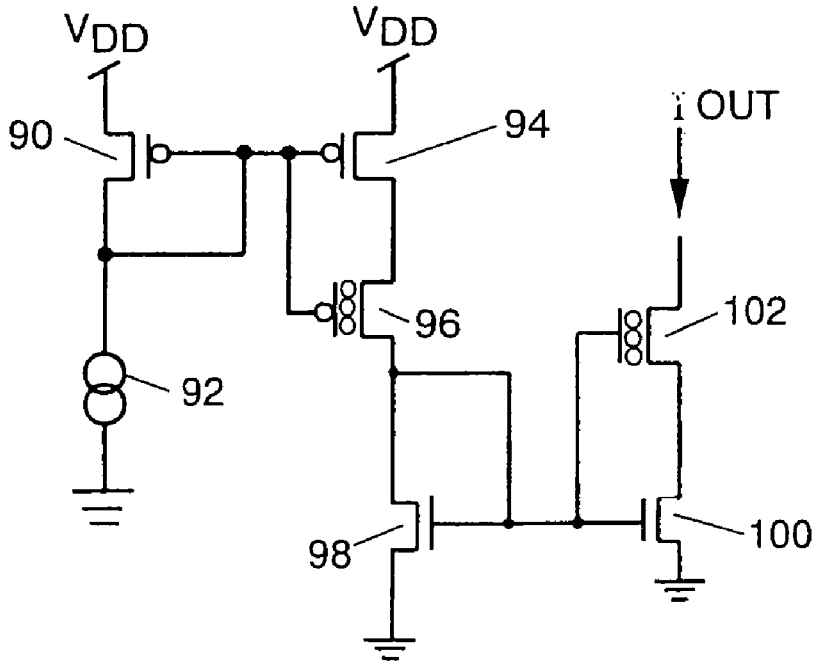

Referring now to FIG. 9D, a multiple zero-threshold current mirror structure is shown. P-channel MOS transistor 90 is coupled between $V_{DD}$ and a current source 92 referenced to ground. Its gate and drain are coupled to the gate of p-channel MOS transistor 94, whose source is also coupled to $V_{DD}$. The drain of p-channel MOS transistor 94 is coupled to the source of zero-threshold p-channel MOS transistor 96, and its gate is coupled to the gates of p-channel MOS transistors 90 and 94. The drain of zero-threshold p-channel MOS transistor 96 is coupled to the drain and gate of n-channel MOS transistor 98. N-channel MOS transistor 100 is coupled in series with zero-threshold n-channel MOS transistor 102 between ground and the current-output node of the circuit.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A current mirror comprising:

a current source;

a first p-channel MOS transistor having a source coupled to an operating potential, and a gate and a drain coupled to said current source;

a second p-channel MOS transistor having a source coupled to said operating potential, a gate coupled to said gate of said first p-channel MOS transistor, and a drain;

a zero-threshold p-channel MOS transistor having a source coupled to said drain of said second p-channel MOS transistor, a gate coupled to said gate of said first p-channel MOS transistor, and a drain;

a first n-channel MOS transistor having a source coupled to ground, and a gate and drain coupled to said drain of said zero-threshold p-channel MOS transistor;

a second n-channel MOS transistor having a source coupled to ground, a gate coupled to said gate of said first n-channel MOS transistor, and a drain; and a zero-threshold n-channel MOS transistor having a source coupled to said drain of said second n-channel MOS transistor, a gate coupled to said gate of said first n-channel MOS transistor, and a drain coupled to a current-output node.

2. The current mirror of claim 1, wherein said current source is referenced to ground.

3. The current mirror of claim 1, wherein said second n-channel MOS transistor is coupled in series with said zero-threshold n-channel MOS transistor between ground and said current-output node.

4. The current mirror of claim 3, wherein said source of said zero-threshold n-channel MOS transistor is directly coupled to said drain of said second n-channel MOS transistor.

5. The current mirror of claim 3, wherein the only component of said current mirror directly connected to said current-output node is said drain of said zero-threshold n-channel MOS transistor.

6. The current mirror of claim 1, wherein said gate of said second p-channel MOS transistor is coupled to said drain of said first p-channel MOS transistor.

7. The current mirror of claim 1, wherein said gate of said zero-threshold p-channel MOS transistor is coupled to said drain of said first p-channel MOS transistor.

8. The current mirror of claim 1, wherein said gate of said zero-threshold p-channel MOS transistor is coupled to said gate of said second p-channel MOS transistor.

9. The current mirror of claim 1, wherein said gate of said second n-channel MOS transistor is coupled to said drain of said zero-threshold p-channel MOS transistor.

10. The current mirror of claim 1, wherein said gate of said second n-channel MOS transistor is coupled to said drain of said first n-channel MOS transistor.

11. The current mirror of claim 1, wherein said gate of said zero-threshold n-channel MOS transistor is coupled to said gate of said second n-channel MOS transistor.

* * * * *